US011441423B2

(12) United States Patent
Valiante et al.

(10) Patent No.: US 11,441,423 B2
(45) Date of Patent: Sep. 13, 2022

(54) METHOD AND APPARATUS FOR THE BOTTOM-UP CONSTRUCTION OF VERTICAL RISERS FROM UNDERGROUND PASSES THROUGH THE SOIL, USING A PIPE JACKING EQUIPMENT

(71) Applicant: SALINI IMPREGILO S.P.A., Milan (IT)

(72) Inventors: Nicola Valiante, Monza (IT); Alberto Buffa, Saronno (IT)

(73) Assignee: WEBUILD S.P.A., Milan (IT)

( * ) Notice: Subject to any disclaimer, the term of this patent is extended or adjusted under 35 U.S.C. 154(b) by 0 days.

(21) Appl. No.: 17/055,927

(22) PCT Filed: May 16, 2018

(86) PCT No.: PCT/IT2018/000071

§ 371 (c)(1),
(2) Date: Nov. 16, 2020

(87) PCT Pub. No.: WO2019/220468

PCT Pub. Date: Nov. 21, 2019

(65) Prior Publication Data

US 2021/0222495 A1 Jul. 22, 2021

(51) Int. Cl.

| | |
|---|---|
| ***E21D 9/00*** | (2006.01) |
| ***E21D 9/10*** | (2006.01) |
| *E21D 3/00* | (2006.01) |

(52) U.S. Cl.
CPC ..... *E21D 9/1066* (2013.01); *E21D 9/10* (2013.01); *E21D 3/00* (2013.01)

(58) Field of Classification Search
CPC ..... E21D 9/1066; E21D 9/10; E21D 3/00
See application file for complete search history.

(56) References Cited

U.S. PATENT DOCUMENTS

| | | | | |
|---|---|---|---|---|
| 3,399,738 | A * | 9/1968 | Haspert | E21B 21/01 175/320 |
| 3,604,754 | A | 9/1971 | Kampf-Enden | |
| 5,879,057 | A * | 3/1999 | Schwoebel | E21B 43/292 299/56 |
| 7,004,679 | B2 | 2/2006 | Naka et al. | |
| 2003/0094311 | A1 | 5/2003 | Itou et al. | |

FOREIGN PATENT DOCUMENTS

| | | | |
|---|---|---|---|
| CN | 105041204 | A | 11/2015 |
| DE | 1 758 505 | A1 | 3/1971 |
| JP | 2002-106289 | A | 4/2002 |
| WO | WO 2015/087311 | A2 | 6/2015 |

* cited by examiner

*Primary Examiner* — Janine M Kreck
(74) *Attorney, Agent, or Firm* — Muncy, Geissler, Olds & Lowe, P.C.

(57) ABSTRACT

A "Riser Concept" Method and Apparatus includes the bottom-up construction of vertical risers from underground passes through the soil, using a pipe jacking equipment. The pipe jacking equipment vertically push the riser pipe from underground pass upwards through soil formations to water-body, air intake, terrain surface or like. The method and mechanism can be applied either in traditionally bored tunnel or in tunnel bored by tunnel boring machine.

8 Claims, 10 Drawing Sheets

PRIOR ART

PRIOR ART

METHOD AND APPARATUS FOR THE BOTTOM-UP CONSTRUCTION OF VERTICAL RISERS FROM UNDERGROUND PASSES THROUGH THE SOIL, USING A PIPE JACKING EQUIPMENT

This nonprovisional application is a National Stage of International Application No. PCT/IT2018/000071, which was filed on May 16, 2018, and which is herein incorporated by reference.

BACKGROUND OF THE INVENTION

Field of the Invention

The present invention relates to an innovative technique providing a one-pass operation that, while vertically excavates through soil formation, installs riser segments from underground to upward.

In the following, such a technique will be also called as: "Riser Concept".

According to the invention, it is provided a pipe jacking equipment for vertically pushing the riser pipe from underground to pass upwards through soil formations to waterbody, air intake, terrain surface or the like. The invention can be applied either in traditionally bored tunnel or in tunnel bored by Tunnel Boring Machine (TBM).

Description of the Background Art

Heretofore, several methods have been designed for excavating vertical or slightly inclined bore holes from a gallery, shaft or like at one level to a gallery, shaft or like at another level, but no previous methods permit to build vertical risers from an underground lower level to upper level, through soil, especially in underwater applications (see table below).

| COMPARISON TABLE | | Riser Concept | Raise Boring | Boxhole Boring | Direct Pipe |
|---|---|---|---|---|---|
| GEOLOGY | Soil | YES | NO | NO | YES |
| CONDITION | Underwater | YES | NO | NO | YES |
| DIRECTION | Upward | YES | YES | YES | YES |
| ROUTE | Vertical | YES | YES | YES | NO |
| LAUNCH POSITION | Underground | YES | NO | YES | NO |
| PERMANENT LINING | Pipe | YES | NO | NO | YES |
| SEALING SYSTEM | Water | YES | NO | NO | YES |
| | Excavated Material | YES | NO | YES | YES |

According to the table, no existing method and apparatus permit to construct vertical risers with permanent lining, excavating bottom-up through soil from underground position.

US 2003/094311 A1 discloses a cutter structure for a shield machine configured to be advanced by boring through a tunnel wall of an existing tunnel. When the shield machine is caused to advance in the upward direction, an advancing seal is connected to an advancing section ring of an exavatable wall. A cutter is rotated by using a motor, while jacks elongate in order to determine rising of the machine in the upward direction. Then, the excavatable wall is gradually cut away from its inner peripheral surface by bits, mounted on the rotating cutter. An excavating surface of a workface defined by rotation of the cutter is configured so as to have a curved shape, such that the excavatable wall can be excavated with a cylindrical form. Accordingly, as the machine advances by boring through the excavatable wall, the bits open an elliptical hole, diametrically extending outward from a central portion of the cutter.

U.S. Pat. No. 7,004,679 B2 discloses an easily-cuttable tunnel segment structure, formed by connecting a plurality of easily-cuttable tunnel segment pieces to each other in the longitudinal direction of a tunnel, so that an area of the easily-cuttable tunnel segment structure to be cut (corresponding to an area to be tunneled by a shield machine for forming a branch tunnel) extends over the plurality of segment pieces.

WO 2015/087311 A2 discloses a procedure for constructing underground transport infrastructures comprising excavating at least an underground transport tunnel comprising a first pipe and a second pipe, substantially parallel to one another, and making at least a bypass tunnel connecting said first pipe and said second pipe. The step of making the bypass tunnel comprises: introducing a launching chamber along said first pipe up to a first predefined position chosen along the longitudinal direction of said first pipe, said launching chamber being able to launch at least a tunnel boring machine; introducing an arrival chamber along said second pipe, up to a second predefined position chosen along the longitudinal direction of said second pipe, said arrival chamber being able to receive said tunnel boring machine; and excavating said bypass tunnel by making said tunnel boring machine move forward from said launching chamber to said arrival chamber along a direction transversal with respect to said first pipe and said second pipe.

Further prior art relating to a system for the bottom-up construction of vertical riser pipes from underground tunnels, passes or the like is disclosed, for example, in DE 17 58 505 A1, JP 2002 106289 A and CN 105 041 204 A.

In view of the above, a first object of the invention is to provide a method and apparatus conceived to provide one-pass operation of soil excavation and riser segments permanent installation in vertical risers, excavating upwards from underground passes through soil by means of a pipe jacking equipment.

A second object of invention is to provide a method and apparatus to displace and remove the soil by a displacement head, equipped by hydro-demolition system, to allow weakening dense soil and a soil discharge line to extract excavate soils.

A third object of invention is to provide a method and apparatus for providing the precise settle of a keystone launching segment connected with a displacement head. This aim is achieved by using special segment rings, provided by slotted holes or the like, which enable an on-site rotational adjustability of the keystone launching segment.

A fourth object of invention is to provide a method and apparatus for installing riser segments as permanent lining of the vertical riser.

A fifth object of invention is to provide a method and apparatus configured and designed for underwater application by means of sealing systems.

SUMMARY OF THE INVENTION

The present invention relates to the technical field of earth boring and more particularly relates to a method and apparatus wherein a pipe jacking equipment is provided, to install vertical risers by pushing upward riser segments into soil formations, from an underground pass to an upper level. The excavation and removal of the soil is achieved by a displacement head, equipped with a hydro-demolition system and a soil discharge line.

According to the invention, said displacement head is fastened to a keystone launching segment, equipped with a sealing system configured to connect the riser and the tunnel, to guarantee a watertight connection.

The above objects and further aims are obtained according to the present invention by providing a pipe jacking equipment that vertically push upwards the riser, divided into segments, from underground position to upper level through soil formation, even in underwater applications.

This invention is further provided with sealing systems configured to allow underwater applications and to guarantee a watertight connection between the segments of the riser themselves.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus, are not limitive of the present invention, and wherein.

DETAILED DESCRIPTION

Figure 1:
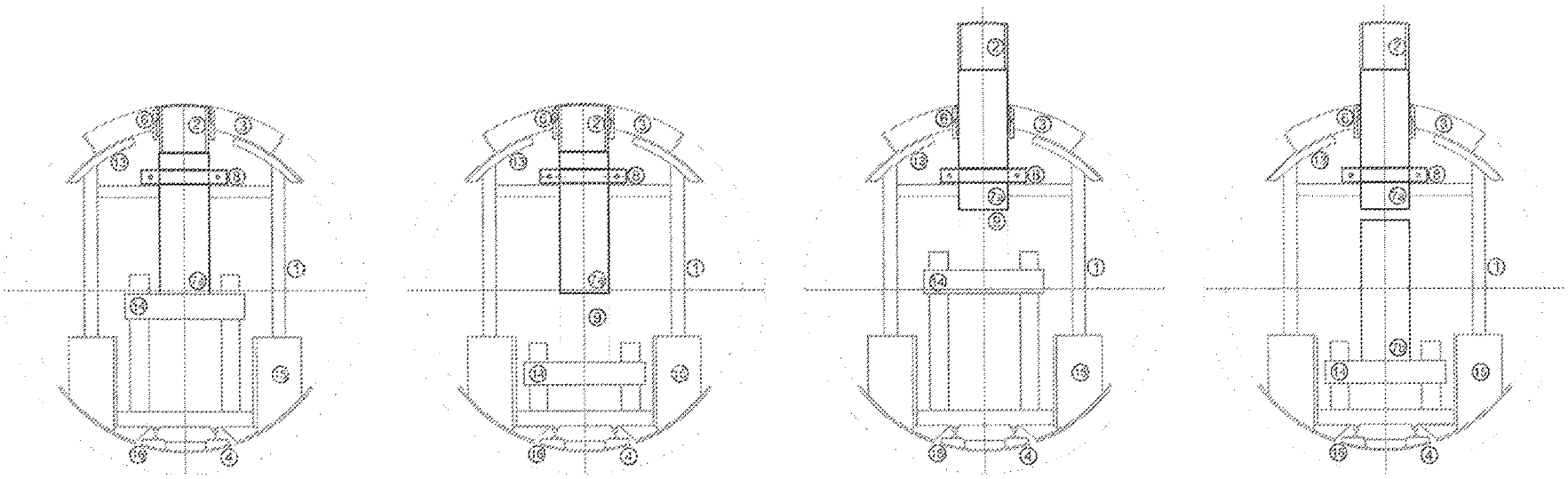
FIG. 1 is a schematic cross section of a preferred embodiment of the invention showing installation stages of riser segments.
Figure 2:
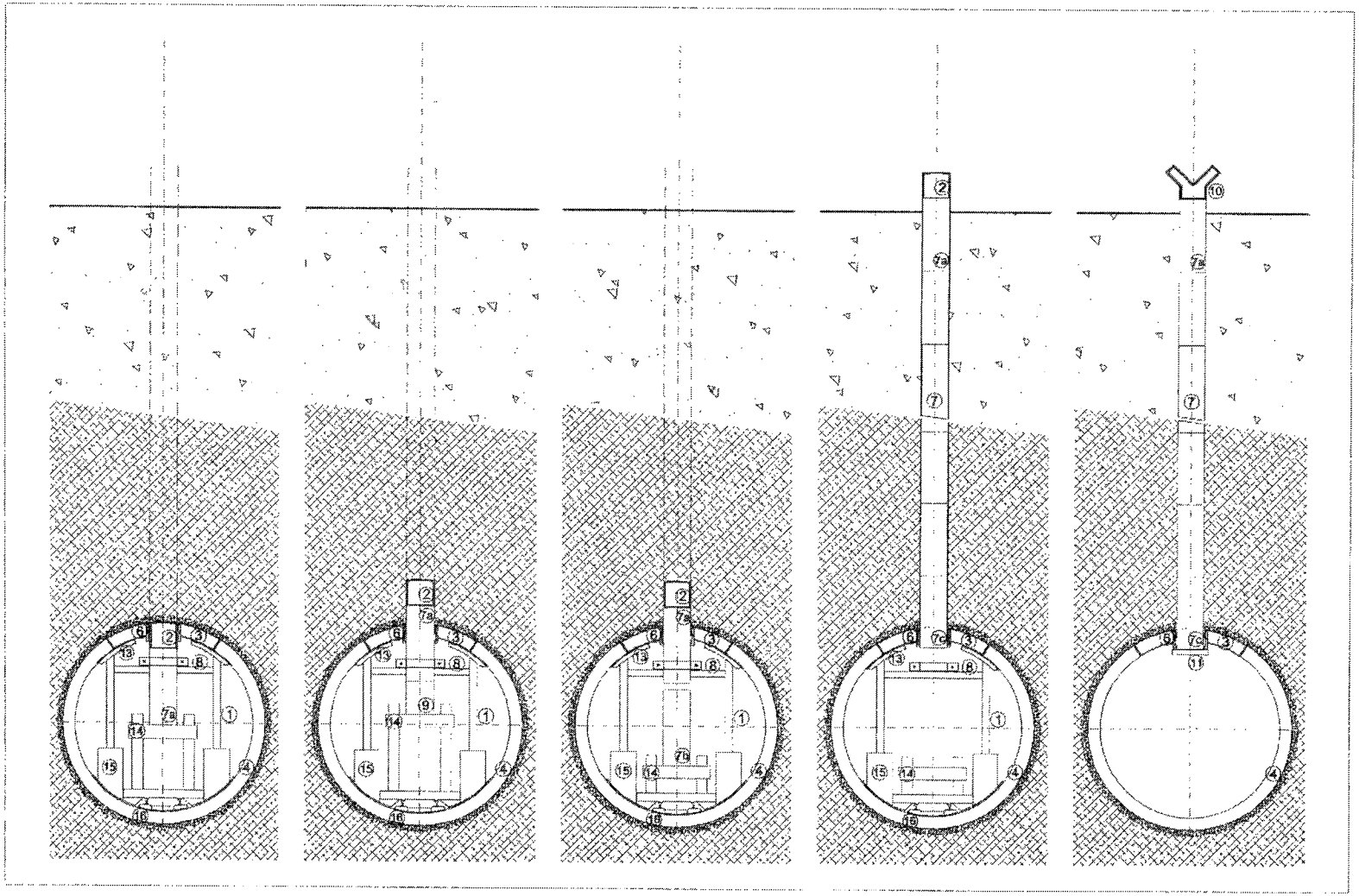
FIG. 2 is a schematic cross section according to FIG. 1 showing an overview of riser segments installation.
Figure 3:
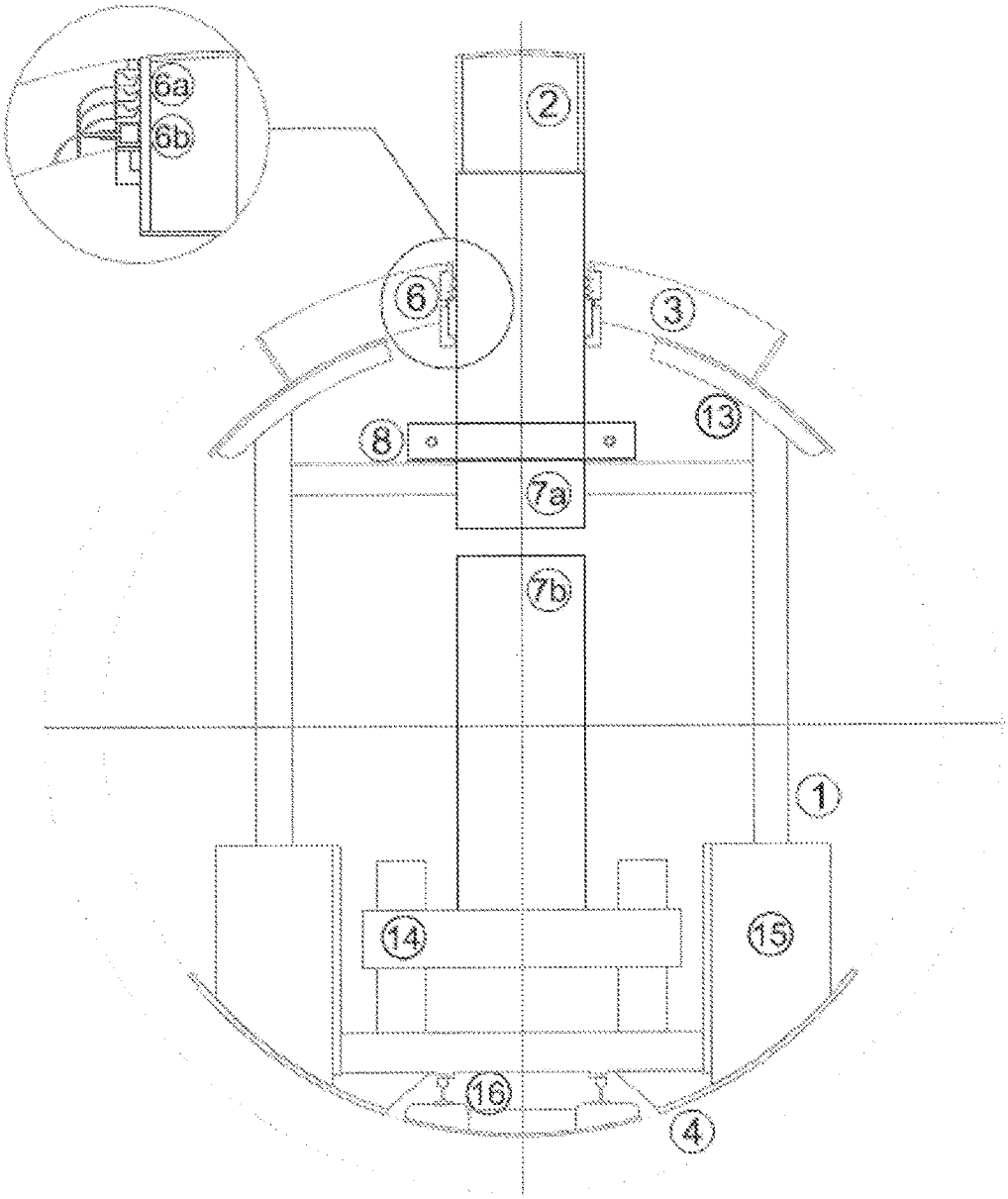
FIG. 3 shows, in greater detail, the schematic cross section of last drawing of FIG. 1.
Figure 4:
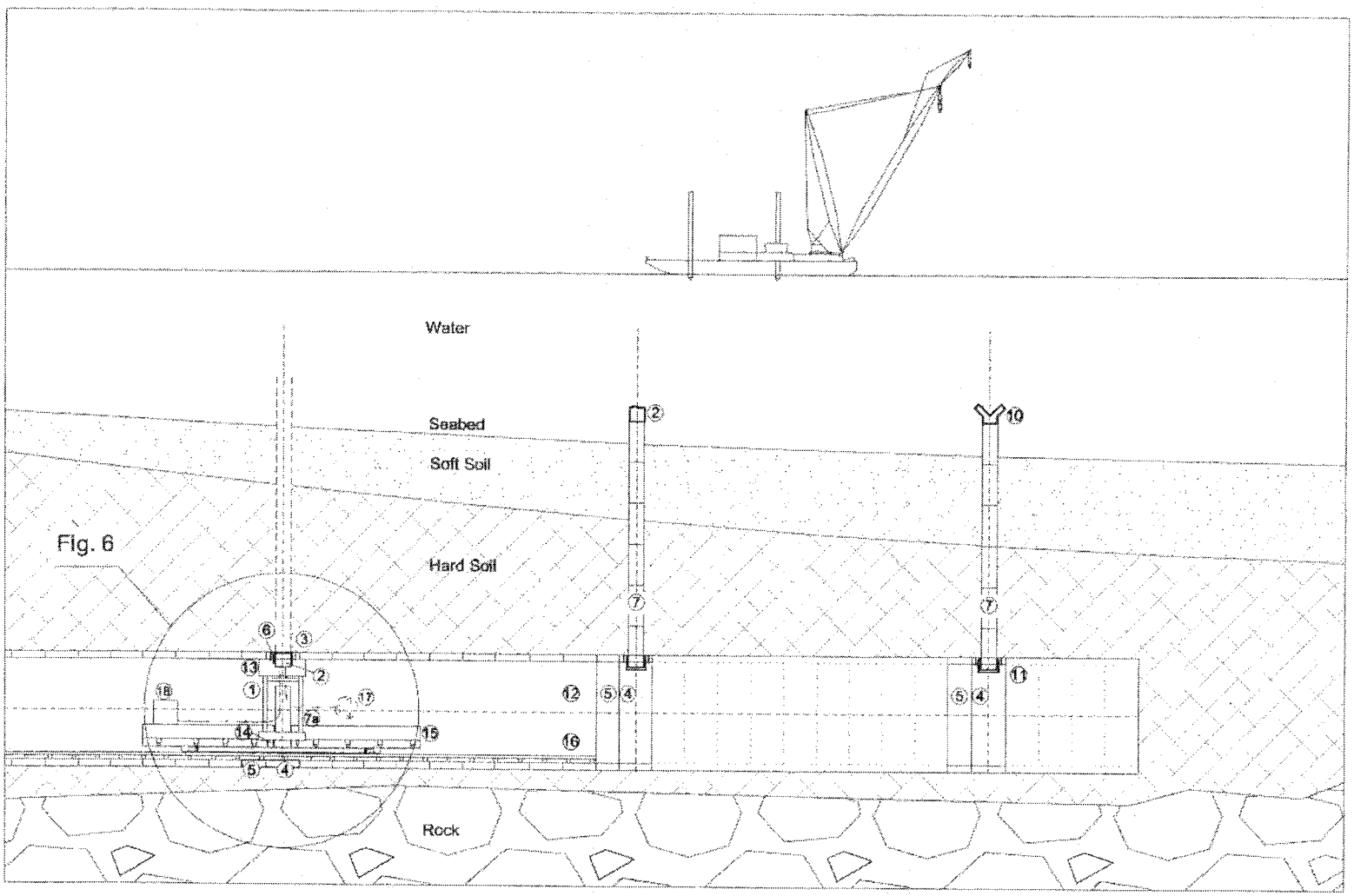
FIG. 4 is a schematic longitudinal section showing an overview of a plurality of riser segments installation.
Figure 5:
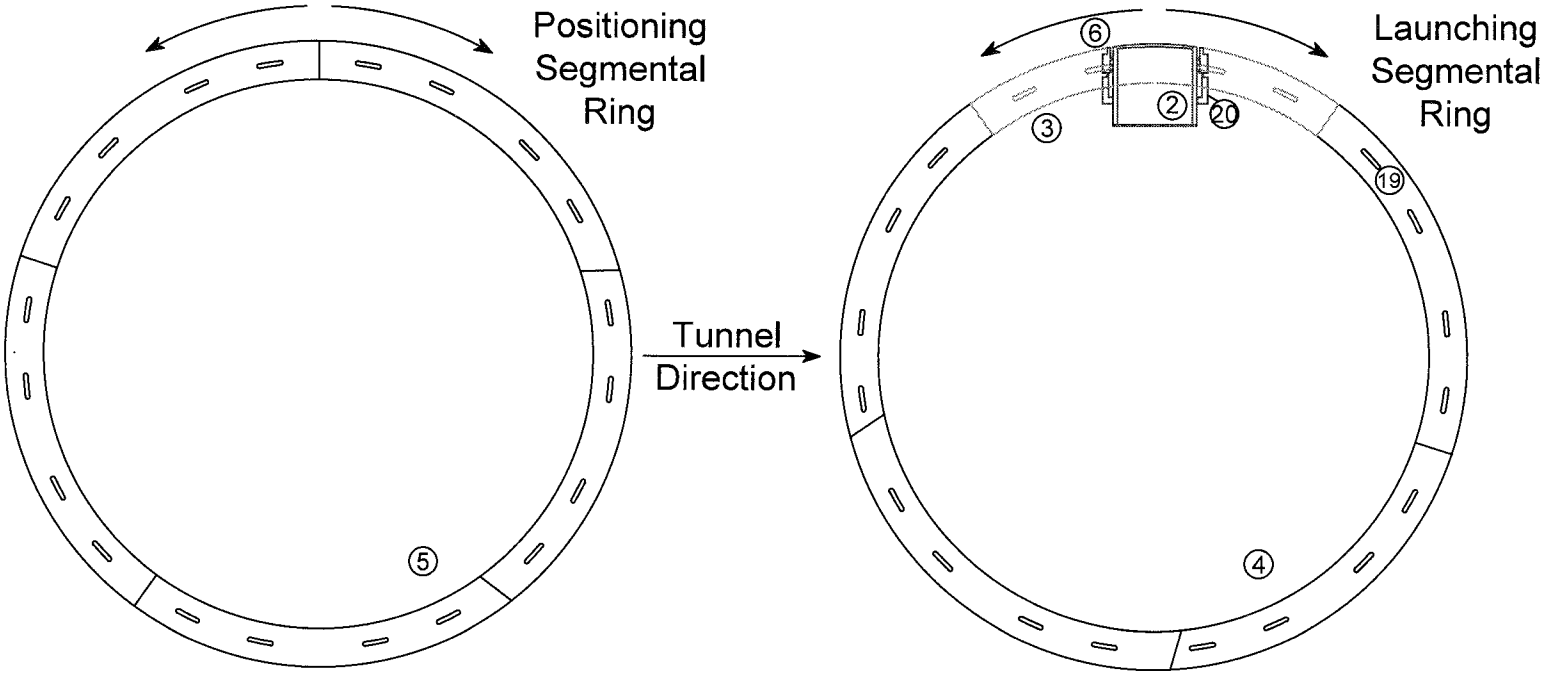
FIG. 5 is a schematic cross section showing the special segment rings: the positioning segmental ring and the launching segmental ring.
Figure 6:
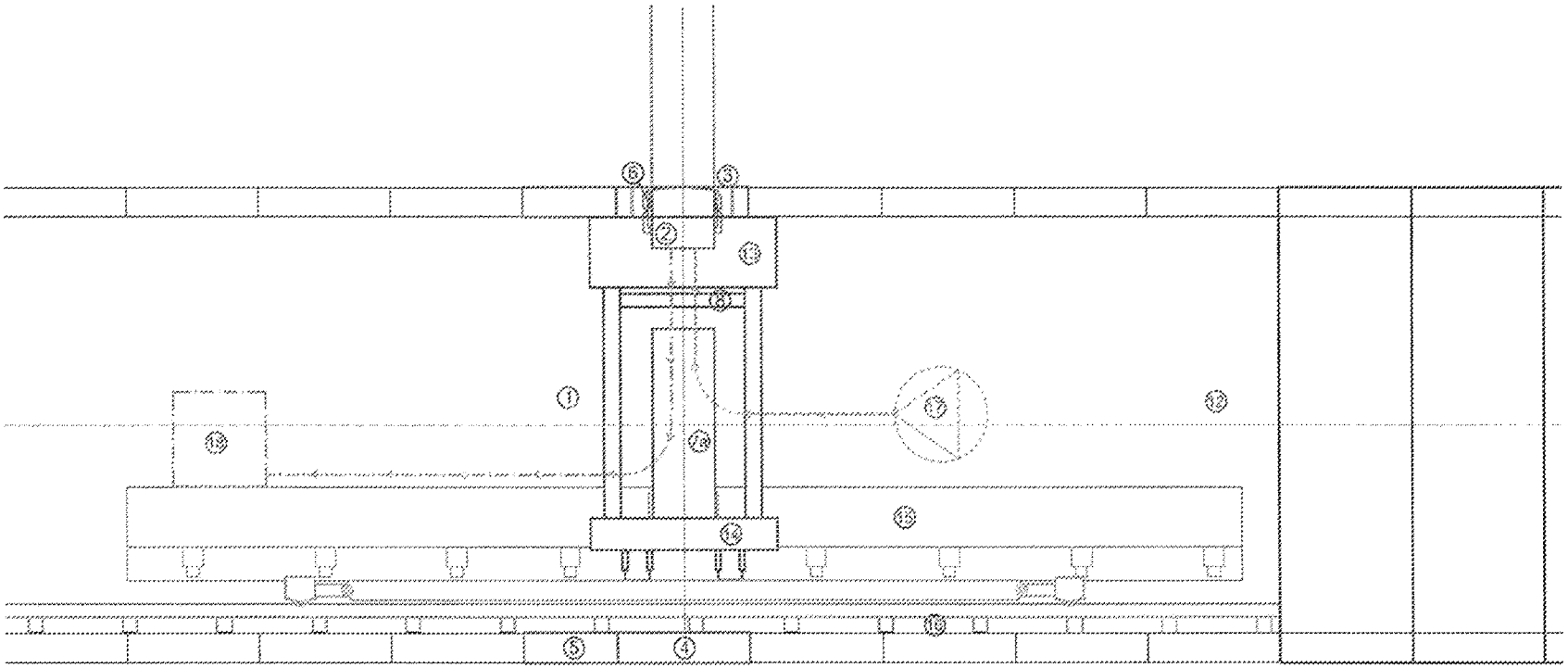
FIG. 6 shows, in greater detail, the schematic longitudinal section of pipe jacking equipment.

In case of applying the invention in TBM tunnels (FIGS. 1-5), the method according to the "Riser Concept" of the present invention provides initially to install two special segment rings: a positioning segmental ring (5) and a launching segmental ring (4). Considering the direction of the TBM advance, the first ring is the positioning segmental ring (5), and the second one is the launching segmental ring (4), characterized by a keystone launching segment (3).

A displacement head (2) is fastened to keystone launching segment (3), which has previously been placed in the desired position for the installation of the riser (7). The displacement head (2) is fastened to the keystone launching segment (3) by means of removable connections elements 20 (see, e.g., FIG. 5).

According to a peculiar feature of the invention, the correct position of keystone launching segment (3) is adjustable by regulating the rotation of said special segment rings through special slotted holes (19) or the like for the longitudinal connection between the special rings (4, 5). Said slotted holes, or the like, enable an on-site rotational adjustability of the position of keystone launching segment (3).

A sealing system (6), comprising lip gaskets (6A) and additional emergency seals (6B), is configured to ensure the water tightness between riser (7) or displacement head (2) and keystone launching segment (3).

According to the method of the present invention:

a) A pipe jacking equipment (1) is positioned underneath said keystone launching segment (3) and b) A riser initial segment (7A) is placed onto a thrust platform (14);

c) Said riser initial segment (7A) is connected to the displacement head (2) and is hold in the desired position by a pipe clamp (8) and then displacement head (2) is disconnected from keystone launching segment (3) by removing the removable connection elements 20, d) A high-pressure water system (17) and a discharge line system (18) are hooked up to displacement head (2) passing through riser initial segment (7A), e) The pipe jacking equipment (1) starts to drive/push riser initial segment (7A) through the soil, by means of a trust platform (14) and of a hydro-demolition system of displacement head (2) provided with nozzles configured to spray pressurized water to weaken the soil structure in the penetration area of displacement head (2), f) The thrust force is uniformly transferred to the tunnel structure by a load distribution system (15), g) A spacer (9) is placed under the riser initial segment (7A) to drive the segment trough the soil up to the required elevation;

h) In this position, riser initial segment (7A) is blocked by pipe clamp (8), i) The spacer (9) is removed and a riser standard segment (78) is placed on the trust platform and connected to the previous one.

These operations are repeated up to reach the desired elevation when the last segment, a riser ending segment (7C), has to be installed. Such last element is provided with two flanges: one for the permanent connection with keystone launching segment (3) and the other one to fasten a temporary bulkhead (11).

Before removing displacement head (2) from the top of riser initial segment (7A), said temporary bulkhead (11) or the like must be installed at the bottom of riser ending segment (7C) to prevent water from entering in the tunnel.

The final step would be the removal of displacement head (2), the installation of diffuser (10) or the like at the top riser initial segment (7A) and the removal of the temporary bulkhead (11) or the like from the bottom of riser ending segment.

According to the present invention:

All risers comprise at least three segments: riser initial segment (7A), riser standard segment (7B) and riser ending segment (7C).

All the riser segments joints are designed and configured in order to: guarantee the desired structural capacity; avoid damage on the interface of riser segments (7) and sealing system (6) during the pushing operation; ensure water tightness, maximum assembly speed, constructability in an underground working space.

For all jacking operations, before to apply the thrust, pipe clamp (8) is opened to drive riser segment into the soil and after to apply the thrust, pipe clamp (8) is closed to hold riser segment.

High Pressure water system (17) and discharge line system (18) must be disconnected from displacement head (2), passed through each riser segment and reconnected to displacement head (2), before activating the pipe jacking equipment (1).

A preferred embodiment designed to carry out the Riser Concept of the present invention will hereinafter be described, with reference to a non-limitative application thereof.

Figure 9:
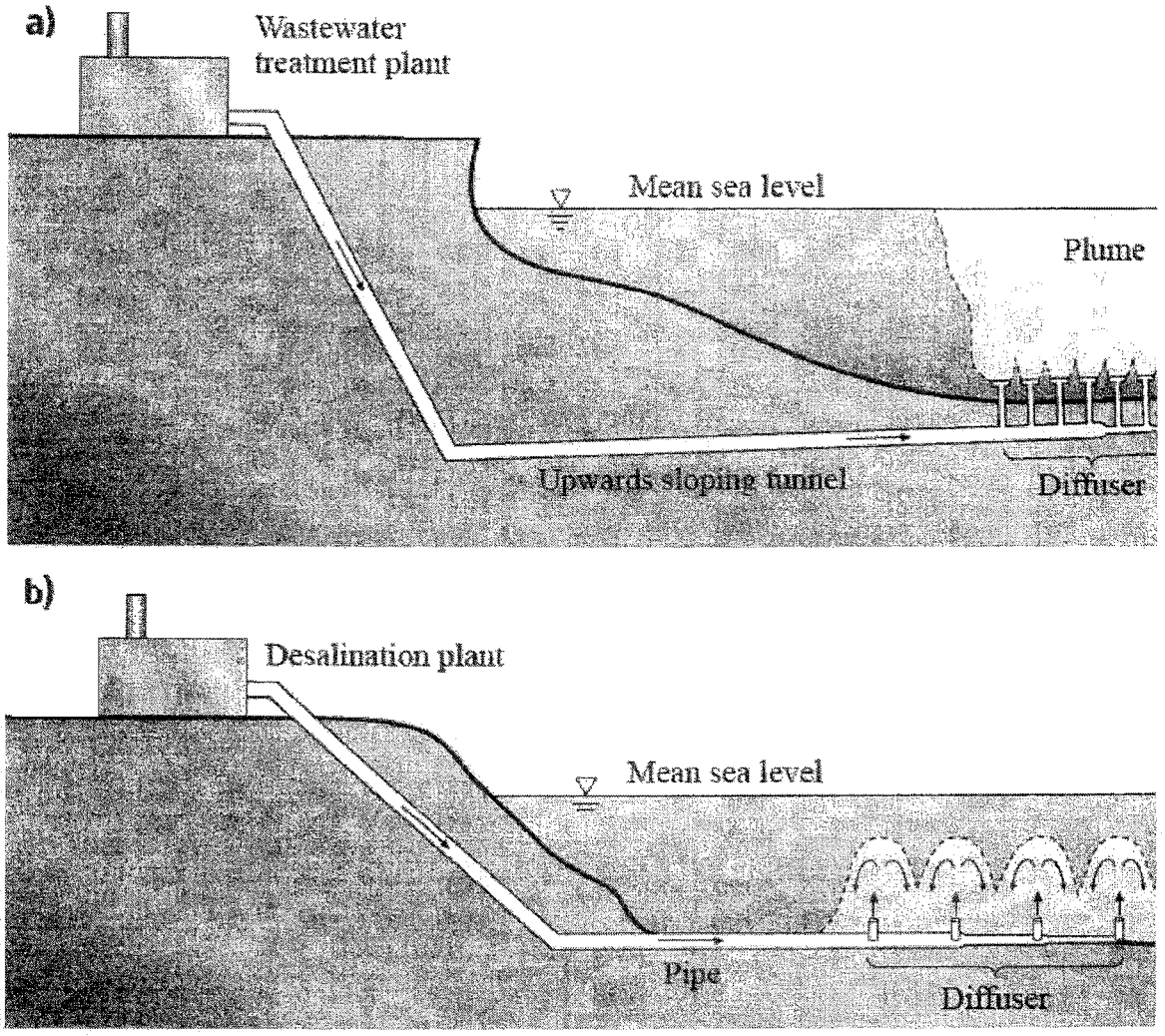
FIG. 9 PRIOR ART
FIG. 9 is a schematic of two side views of known submarine outfall plants (P. Tate—S. Scaturro— B. Cathers, 2016).

A submarine outfall is a pipeline or tunnel that discharges municipal or industrial wastewater, storm water, combined sewer overflow or brine effluent from a wastewater treatment plant or desalination plant into a waterbody. The wastewater treatment plant treats to discharge positively buoyant effluent from a wastewater treatment plant, while the desalination plant treats to discharge negatively buoyant effluent (FIG. 9).

Both schematics show an inclined tunnel from the wastewater plant, the outfall tunnel and a diffuser comprising several risers with outlet nozzles on its top, through which the wastewater is diffused under the water surface (P. Tate—S. Scaturro—B. Cathers, 2016).

Figure 7:
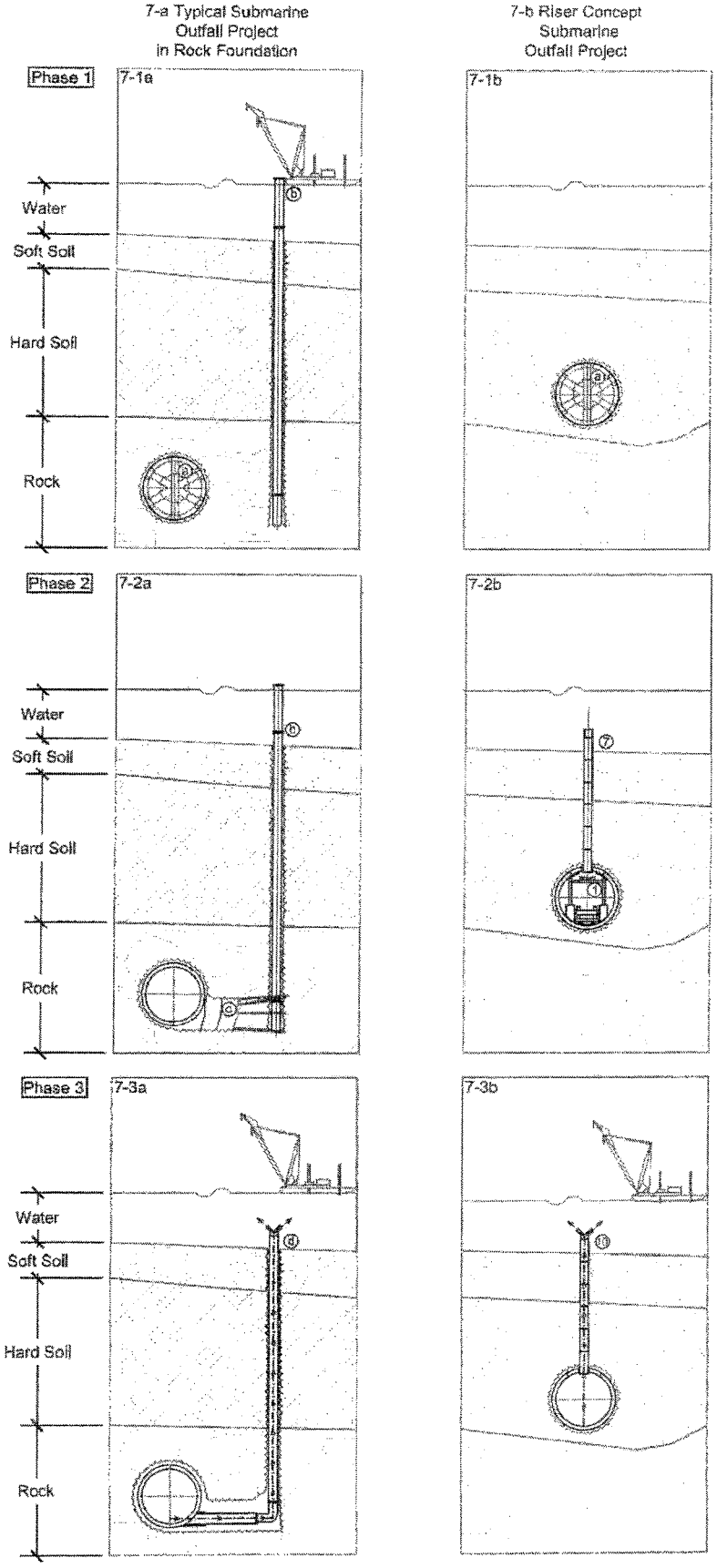
FIG. 7 is a schematic comparison of construction phases in a known typical project in rock foundation and in a submarine outfall tunnel according to the present invention.

In FIGS. 7-*a*, 7-*b*. 8-*a* and 8-*b*, reference character "(a)" denotes a TBM tunnel excavation, reference character "(b)" denotes an offshore riser drill, reference character "(c)" denotes an underground offtake edit drill-and-blast, reference character "(d)" denotes a diffuser installation, reference character "(e)" denotes a waterbody bed dredge, reference character "(f)" denotes a transition shaft and TBM tunnel connection and reference character "(g)" denotes a diffusion pipeline connection. In typical submarine outfall tunnel projects in rock foundation, three main construction stages are executed: the underground tunnel, the maritime offshore risers and the underground offtake edits. In terms of schedule, the installation of risers is performed independently from the execution of the underground tunnel (FIG. 7-1*a*) while the offtake edits start after the completion of the previous two (FIGS. 7-2*a* & 7-3*a*).

Usually, the installation of the diffusion risers represents one of the most critical activities; in fact, this is performed through a multistage offshore work (FIG. 7-1*a*): initially, the bed sediment next to the riser is dredged, then a jack up drilling vessel is floated into position to jack up over riser holes positions, where a drilling template is used to ensure the locations. For each drilling phase, if required, a permanent casing is placed and the annular void between the drilled hole and the casing is filled with grout. Once the required level is achieved, the riser is lowered to be installed, grouted, and capped.

Figure 10:
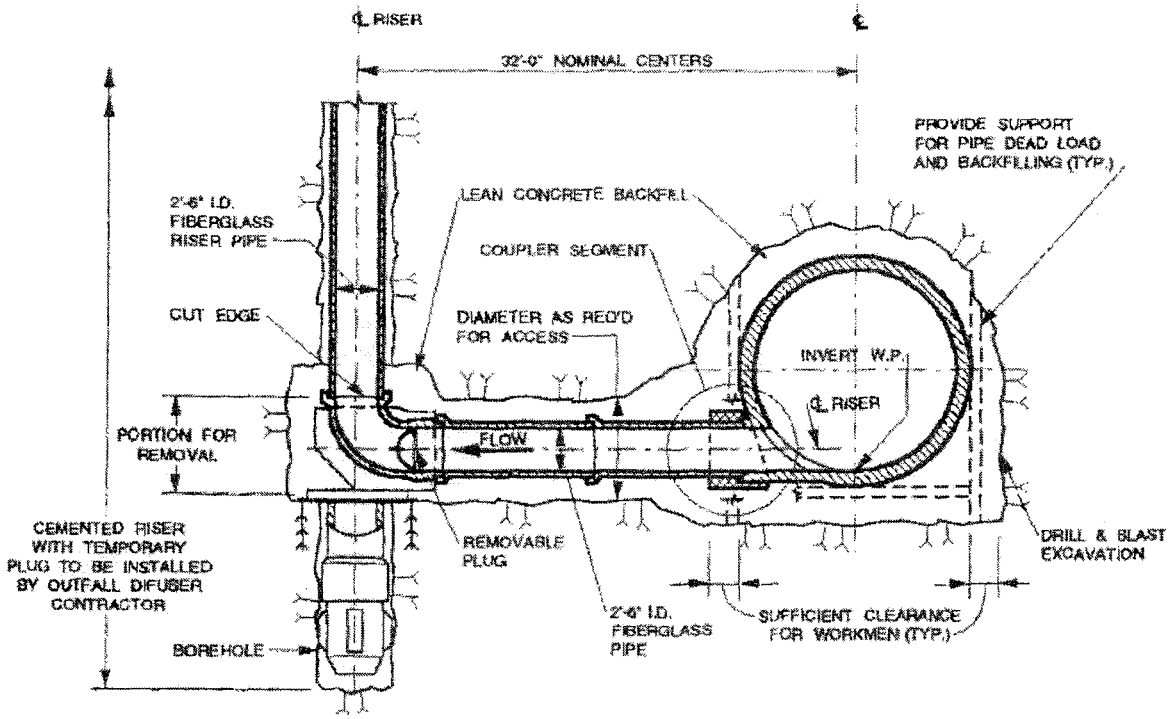
FIG. 10 PRIOR ART
FIG. 10 is a tunnel-diffuser cross section of known Boston Outfall project, showing the offtake tunnel (Eisenberg & Brooks, 1992).

The connection of the offshore work to the underground work represents a challenging operation: "probe holes are drilled from the tunnel to ascertain the location of the pre-installed risers and to drain the risers of ballast water", then the offtake adits are excavated to expose the risers (FIG. 7-2*a*), which afterwards are cut and permanently linked to the tunnel through an elbow section (FIG. 7-3*a* & FIG. 10).

In typical submarine outfall tunnel projects in soil foundation, three main construction stages are executed: the underground tunnel, the maritime transition shaft and a diffusion pipeline equipped by risers anchored on the waterbody bed.

Figure 8:
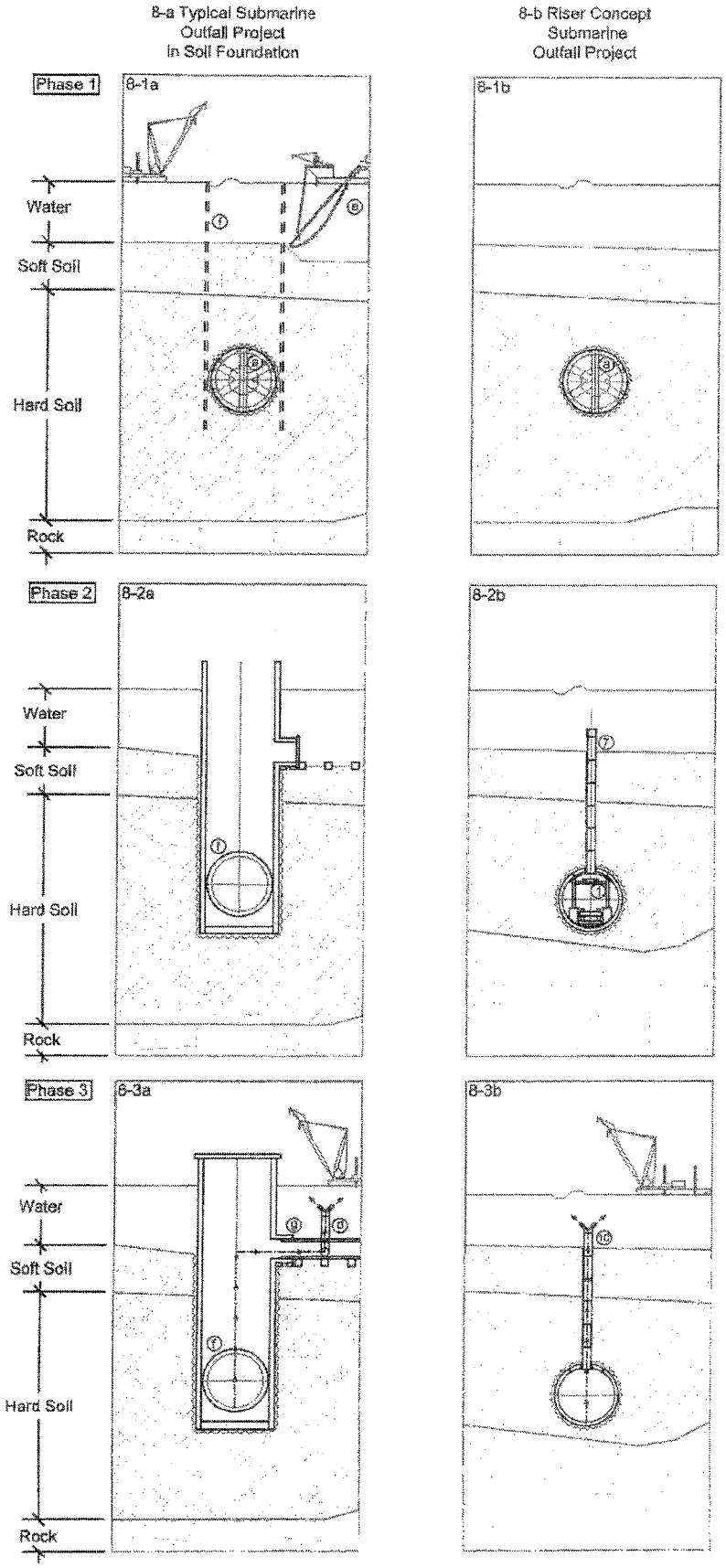
FIG. 8 is a schematic comparison of construction phases in a known typical project in soil foundation and in a submarine outfall tunnel according to the present invention.

In terms of schedule, the connection of diffusion tunnel equipped by risers (FIG. 8-3*a*) is performed after the execution of the underground tunnel (FIG. 8-1*a*) and maritime transition shafts (FIG. 8-2*a*).

Typically, the connection between tunnel and the transition shaft (FIG. 8-2*a*) and the connection between the transition shaft and the diffusion pipeline (FIG. 8-3*a*), represent the most critical activities, performed through a multistage offshore work.

In submarine outfall tunnel projects, adopting the solution of the Riser Concept according to the present invention, the construction stages are simplified and in general two main construction stages are executed: the excavation of the tunnel and the construction of the risers from inside the tunnel, both underground (FIGS. 7*b* and 8*b*). In terms of schedule, the installation of risers (FIGS. 7-2*b* and 8-2*b*) is performed after the execution of the tunnel (FIGS. 7-1*b* and 8-1*b*).

Then, in the non-limitative embodiments thereof submarine outfall project construction, the adoption of Riser Concept provides several benefits and advantages, such as:

1. Elimination of several works:

a. maritime offshore works, i.e. dredging of the bed sediment, drilling of a riser hole, installation of permanent casing, grouting by a vessel; or, dredging of the bed sediment, construction of underwater foundation, underwater installation of pipes.

b. underground activities, i.e. riser probe drilling, drill-and-blast adits excavation, installation of permanent lining and grouting; or, connection between tunnel and transition shaft, connection between transition shaft and diffusion tunnel.

2. Elimination of various maritime operations:

a. Avoidance of potential construction delays, due to suspension of maritime operations, which can be inevitably induced by marine conditions.

b. Minimization navigation traffic disruptions.

c. Mitigation of negative environmental impacts caused by dredging and drilling activities, such as may be destruction of habitats, suspension of sediments, resettling of fishes, and displacement of infauna and marine plants.

3. Attaining a reduction of both construction cost and operational cost:

a. During construction: the total cost of the project is reduced due to the elimination of several complex works, and substantial reduction of maritime operations;

b. During the operational life: the hydraulic performance inside the tunnel is much improved, as encountered hydraulic losses are less, with a reduction of energy consumption.

While a preferred embodiment of the invention has been described using specific terms, such description is for illustrative purposes only, and it is to be understood that changes and variations may be made without departing from the spirit or scope of the following claims.

While a preferred embodiment of the invention has been described using specific terms, such description is for illustrative purposes only, and it is to be understood that changes and variations may be made without departing from the scope of the following claims.

The invention being thus described, it will be obvious that the same may be varied in many ways. Such variations are not to be regarded as a departure from the spirit and scope of the invention, and all such modifications as would be obvious to one skilled in the art are to be included within the scope of the following claims.

What is claimed is:

1. System for the bottom-up construction of vertical riser pipes from underground tunnels to an upper waterbody through the soil, wherein the system comprises: one or more vertical riser pipes comprising at least three riser pipe segments; a pipe jacking equipment which is configured to install said one or more vertical riser pipes by pushing said at least three riser pipe segments into soil formations in the upward direction, from an underground tunnel to an upper level, a load distribution system, configured to transfer thrust force to a tunnel structure during installation of said one or more vertical riser pipes, and a displacement head configured to perform excavation and removal of soil, wherein said displacement head is equipped with a hydro-demolition system and a soil discharge line; wherein said displacement head is fastened, by means of removable connection elements, to a keystone launching segment equipped with a sealing system configured to connect, with a watertight connection, each riser and the tunnel to allow underwater applications, and wherein said sealing system comprises lip gaskets and additional emergency seals, and is configured to ensure the water tightness between each of the vertical riser pipes or the displacement head, and the keystone launching segment.

2. System according to claim 1, further comprising two special segment rings: a positioning segmental ring and a launching segmental ring, which are configured so that, considering the direction of the tunnel advance, the first ring is the positioning segmental ring, and the second ring is the launching segmental ring comprising said keystone launching segment.

3. System according to claim 2, wherein the correct position of said keystone launching segment is adjustable by regulating the position of said segmental ring through slotted holes for longitudinally connecting said two special segment rings to each other, the provision of said slotted holes, enabling an on-site rotational adjustability of the position of the keystone launching segment.

4. System according to claim 1, wherein said displacement head is initially fastened to said keystone launching segment, previously placed in a desired position for the installation of the vertical riser pipe.

5. Method for the bottom-up construction of vertical risers from underground tunnels to an upper waterbody, air intake, terrain surface or the like through the soil by means of the system according to claim 2, wherein the method comprises the following steps:

a) positioning of the special segment rings, including said keystone launching segment, said displacement head and said sealing system;
b) positioning said pipe jacking equipment underneath said keystone launching segment;
c) placing an initial riser pipe segment of the at least three riser pipe segments onto a thrust platform;
d) connecting said initial riser pipe segment to the displacement head and holding said initial riser pipe segment in a desired position by means of a pipe clamp, and then disconnecting said displacement head from said keystone launching segment, by removing said removable connection elements;
e) hooking up of a high-pressure water system and a discharge line system to said displacement head, the high-pressure water system and the discharge line system passing through said initial riser pipe segment;
f) starting operation of the pipe jacking equipment to drive/push said initial riser pipe segment through the soil, by means of said thrust platform and the hydro-demolition system of said displacement head provided with nozzles configured to spray pressurized water to weaken the soil structure in the penetration area of said displacement head;
g) removal of the high pressure water system and the discharge line system which have to be passed back through said initial riser pipe segment;
h) uniformly transferring the thrust force to the tunnel structure by said load distribution system;
i) placing a spacer under the initial riser pipe segment to drive the initial riser pipe segment through the soil up to the required elevation;
j) blocking, in this position, said initial riser pipe segment by said pipe clamp;
k) removing the spacer and placing an intermediate riser pipe segment of the at least three riser pipe segments on the thrust platform, and connecting said intermediate riser pipe segment to the initial riser pipe segment; and
l) repeating the steps from e) to k) to reach the desired elevation when an ending riser pipe segment of the at least three riser pipe segments has to be installed.

6. Method according to claim 5, wherein a temporary bulkhead is installed at the bottom of the ending riser pipe segment to prevent water from entering in the tunnel.

7. Method according to claim 6, wherein the final step comprises the removal of said displacement head, the installation of a diffuser at the top of the initial riser pipe segment, and the removal of the temporary bulkhead.

8. System according to claim 1, wherein said at least three pipe riser segments include:

an initial riser pipe segment,
at least one intermediate riser pipe segment, and
an ending riser pipe segment,
wherein said initial riser pipe segment is configured to be connected to the displacement head before starting a jacking process;
wherein said ending rise pipe segment is configured to be connected to the tunnel structure at the completion of the jacking process, and to allow installation of a temporary bulkhead to prevent water from entering into the tunnel structure; and
wherein said at least three riser pipe segments are configured to sustain thrust forces and allow fast joint connection and water tightness of joints and smooth interface with the sealing system.

* * * * *